US009759206B2

(12) United States Patent
Kimoto et al.

(10) Patent No.: US 9,759,206 B2
(45) Date of Patent: Sep. 12, 2017

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Yoshio Kimoto, Aichi-ken (JP); Toru Onishi, Aichi-ken (JP); Kengo Sakakibara, Aichi-ken (JP); Yuki Yokoi, Aichi-ken (JP); Takahisa Ban, Aichi-ken (JP); Ryo Matsubara, Aichi-ken (JP); Noriyuki Shintoku, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 343 days.

(21) Appl. No.: 14/493,696

(22) Filed: Sep. 23, 2014

(65) Prior Publication Data

US 2015/0093263 A1 Apr. 2, 2015

(30) Foreign Application Priority Data

Sep. 27, 2013 (JP) ..... 2013-200884

(51) Int. Cl.
*F04B 27/18* (2006.01)
*F04B 27/12* (2006.01)

(52) U.S. Cl.
CPC ..... *F04B 27/1804* (2013.01); *F04B 27/12* (2013.01); *F04B 27/18* (2013.01);
(Continued)

(58) Field of Classification Search
CPC ..... F04B 27/1018; F04B 27/1813; F04B 27/1831; F04B 2027/1859;
(Continued)

(56) References Cited

U.S. PATENT DOCUMENTS 5,207,078 A 5/1993 Kimura et al.
5,380,168 A * 1/1995 Kimura ..... F04B 27/1018 137/625.11
(Continued)

FOREIGN PATENT DOCUMENTS

DE 4229069 3/1993
JP 05-321829 12/1993
(Continued)

OTHER PUBLICATIONS

Office Action issued in Germany Counterpart Patent Appl. No. 102014219429.6, dated Apr. 20, 2016 , along with an English translation thereof.
(Continued)

*Primary Examiner* — Nathan Zollinger
(74) *Attorney, Agent, or Firm* — Greenblum & Bernstein, P.L.C.

(57) ABSTRACT

A swash plate type variable displacement compressor includes a collection and supply mechanism. The collection and supply mechanism has collection passages, supply passages, an annular space, an inlet port, and an outlet port. The inlet port is communicable with a working collection passage of the collection passages. The outlet port is communicable with a working supply passage of the supply passages. When the inclination angle of the swash plate is maximum, residual refrigerant gas in a compression chamber of collection phase is collected through the working collection passage and the collected refrigerant gas is supplied to a compression chamber of supply phase. On the other hand, when the inclination angle is less than the maximum, residual refrigerant gas is supplied no more into the supply-phase compression chamber.

7 Claims, 11 Drawing Sheets

(52) U.S. Cl.
CPC ..... *F04B 2027/1813* (2013.01); *F04B 2027/1831* (2013.01); *F04B 2027/1872* (2013.01)

(58) Field of Classification Search
CPC ..... F04B 2027/1036; F04B 27/1804; F04B 27/12; F04B 27/18; F04B 2027/1813; F04B 2027/1831; F04B 2027/1872
USPC ..... 417/269
See application file for complete search history.

(56) References Cited

U.S. PATENT DOCUMENTS

| | | | | |
|---|---|---|---|---|
| 5,626,463 | A | 5/1997 | Kimura et al. | |
| 5,785,502 | A * | 7/1998 | Ota | F04B 27/1036 417/222.1 |
| 6,558,133 | B2 | 5/2003 | Fukanuma et al. | |
| 6,786,705 | B2 | 9/2004 | Kurita et al. | |
| 9,470,224 | B2 * | 10/2016 | Ban | F04B 27/1018 |
| 2010/0021318 | A1 | 1/2010 | Makishima et al. | |
| 2014/0127061 | A1 | 5/2014 | Ban et al. | |

FOREIGN PATENT DOCUMENTS

| | | |
|---|---|---|
| JP | H06-117365 | 4/1994 |
| JP | H06-173853 | 6/1994 |
| JP | 2002-213350 | 7/2002 |
| JP | 2003-254231 | 9/2003 |
| JP | 2014-92074 | 5/2014 |

OTHER PUBLICATIONS

Office Action issued in Japan Counterpart Patent Appl. No. 2013-200884, dated Jul. 26, 2016.
Office Action issued in Japan Counterpart Patent Appl. No. 2013-200884, dated Jan. 24, 2017.

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Patent Application Publication No. 6-117365 discloses a swash plate type variable displacement compressor (hereinafter referred to merely as "compressor"). The compressor has front and rear housings, a cylinder block, a drive shaft, a swash plate, an inclination angle change mechanism, six pistons, a displacement control valve, and a collection and supply mechanism.

The cylinder block has therein six cylinder bores around the axis of the drive shaft. The front housing has therein a crank chamber. The rear housing has therein a suction chamber and a discharge chamber that are communicable with each cylinder bore. The drive shaft extends through and is rotatably supported by the front housing and the cylinder block. The swash plate is mounted on the drive shaft and in the crank chamber. The swash plate is rotatable in the crank chamber with the rotation of the drive shaft.

The inclination angle change mechanism includes a link mechanism and a wobbling motion conversion mechanism. The link mechanism is comprised of a lug member, a support arm, and a pin. The lug member is mounted on the drive shaft for rotation therewith and located on the front side of the swash plate in the crank chamber. The support arm is formed behind the lug member and connects the lug member and the swash plate. Each piston is received in its corresponding cylinder bore and a compression chamber is thus formed in the cylinder block. The wobbling motion conversion mechanism is comprised of a thrust bearing, a wobbling plate and a connecting rod. Each piston is connected to the swash plate through the wobbling motion conversion mechanism so that the piston reciprocates in the corresponding cylinder bore with rotation of the swash plate. The displacement control valve controls the pressure of the crank chamber.

The collection and supply mechanism is comprised of a communication passage for each cylinder bore and a bypass groove. The six communication passages are formed in the cylinder block and the number of the communication passages is the same as that of the cylinder bores. Each communication passage is formed in the cylinder block extending radially between the drive shaft hole and its corresponding cylinder bore. The bypass groove is formed circumferentially in part of the outer periphery of a rotary valve mounted on the drive shaft. Any two adjacent communication passages are communicable by the bypass groove of the rotary valve that is rotatable synchronously with the drive shaft.

In operation of the compressor, the rotation of the swash plate on the drive shaft causes each piston to reciprocate in the cylinder bore. As the piston is moved from the top dead center toward the bottom dead center, or during the phase of backward stroke of the piston, refrigerant gas is drawn into the cylinder bore. As the piston is moved from the bottom dead center toward the top dead center in the cylinder bore, or during the phase of the forward stroke of the piston, refrigerant gas in the cylinder bore is compressed and discharged out of the cylinder bore. During the phase of the forward stroke, re-expansion of residual refrigerant gas remaining in the cylinder bore even after the discharge phase occurs, before suctioning of refrigerant gas from the suction chamber. A compression chamber that is formed in a cylinder bore from the end of discharge phase after the end of re-expansion phase will be defined as the compression chamber of collection phase or the collection-phase compression chamber. A compression chamber that is formed in a cylinder bore during the compression of refrigerant gas will be defined as the compression chamber of supply phase or the supply-phase compression chamber. The cylinder bore having therein a collection-phase compression chamber will be defined as the cylinder bore of collection phase or the collection-phase cylinder bore. The cylinder bore having therein a supply-phase compression chamber will be defined as the cylinder bore of supply phase or the supply-phase cylinder bore.

In this compressor, the pressure in the crank chamber is changed by the displacement control valve, so that the inclination angle change mechanism changes the inclination angle of the swash plate with respect to a plane extending perpendicularly to the axis of rotation of the drive shaft. Thus, the stroke length of each piston reciprocated can be changed. Thus, the displacement of refrigerant gas per rotation of the drive shaft can be changed.

In the compressor, the collection-phase cylinder bore is communicable with the supply-phase cylinder bore through the communication passage and the residual refrigerant gas bypass groove, so that the residual refrigerant gas in the collection-phase compression chamber is collected and the refrigerant gas thus collected is supplied to the supply-phase compression chamber. Thus, re-expansion of the residual refrigerant gas is prevented and the volumetric efficiency is improved.

In the above-described conventional compressor, however, noise development tends to occur when the inclination angle is less than the maximum angle, as compared when the swash plate is at the maximum inclination angle position.

Additionally, the collection and supply of residual refrigerant gas causes the temperature of refrigerant gas in the compression chamber to be increased due to the residual refrigerant gas of high temperature and therefore, the power required for the compression is increased. As a result, COP (Coefficient Of Performance) is deteriorated.

The present invention is directed to providing a swash plate type variable displacement compressor that achieves silence in operation and improved COP.

SUMMARY OF THE INVENTION

In accordance with an aspect of the present invention, a swash plate type variable displacement compressor includes a housing, a drive shaft, a swash plate, an inclination angle change mechanism, a plurality of pistons, a control mechanism, and a collection and supply mechanism. The housing has therein a plurality of cylinder bores around an axis of the drive shaft and a crank chamber. The drive shaft is supported by the housing rotatably around the axis of the drive shaft. The swash plate is rotatable with the rotation of the drive shaft in the crank chamber. The inclination angle change mechanism changes the inclination angle of the swash plate with respect to a plane extending perpendicularly to the axis of the drive shaft. A plurality of pistons is reciprocally movably received in the respective cylinder bores in accordance with the rotation of the swash plate and form plurality of compression chambers in the respective cylinder bores. When each piston is moved in the corresponding cylinder bore, re-expansion phase, suction phase, compression phase and discharge phase are caused in the corresponding compression chamber. The control mechanism controls the inclination angle change mechanism. The collection and supply mechanism collects refrigerant gas in one of the compression chamber and supplies the collected refrigerant gas to another of the compression chambers. The one compression chamber is in a phase from an end of the discharge phase until an end of the re-expansion phase and defined as a collection-phase compression chamber. The another compression chamber is in a phase of the compression phase and defined as a supply-phase compression chamber. One of the cylinder bores has therein the collection-phase compression chamber and is defined as a collection-phase cylinder bore. Another of the cylinder bores has therein the supply-phase compression chamber and is defined as a supply-phase cylinder bore. The collection and supply mechanism has a communication passage for providing communication between the collection-phase cylinder bore and the supply-phase cylinder bore. The collection and supply mechanism has a communication passage for providing communication between the collection-phase cylinder bore and the supply-phase cylinder bore. The collection and supply mechanism opens the communication passage at a maximum value of the inclination angle of the swash plate and closes the communication passage at a minimum value of the inclination angle of the swash plate.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

The following will describe the first through fifth embodiments according to the present invention with reference to the drawings. Compressors according to the embodiments of the present invention are swash plate type variable displacement compressors. The compressor is mounted on a vehicle and forms a part of the refrigeration circuit for an air conditioner.

First Embodiment

Figure 1:
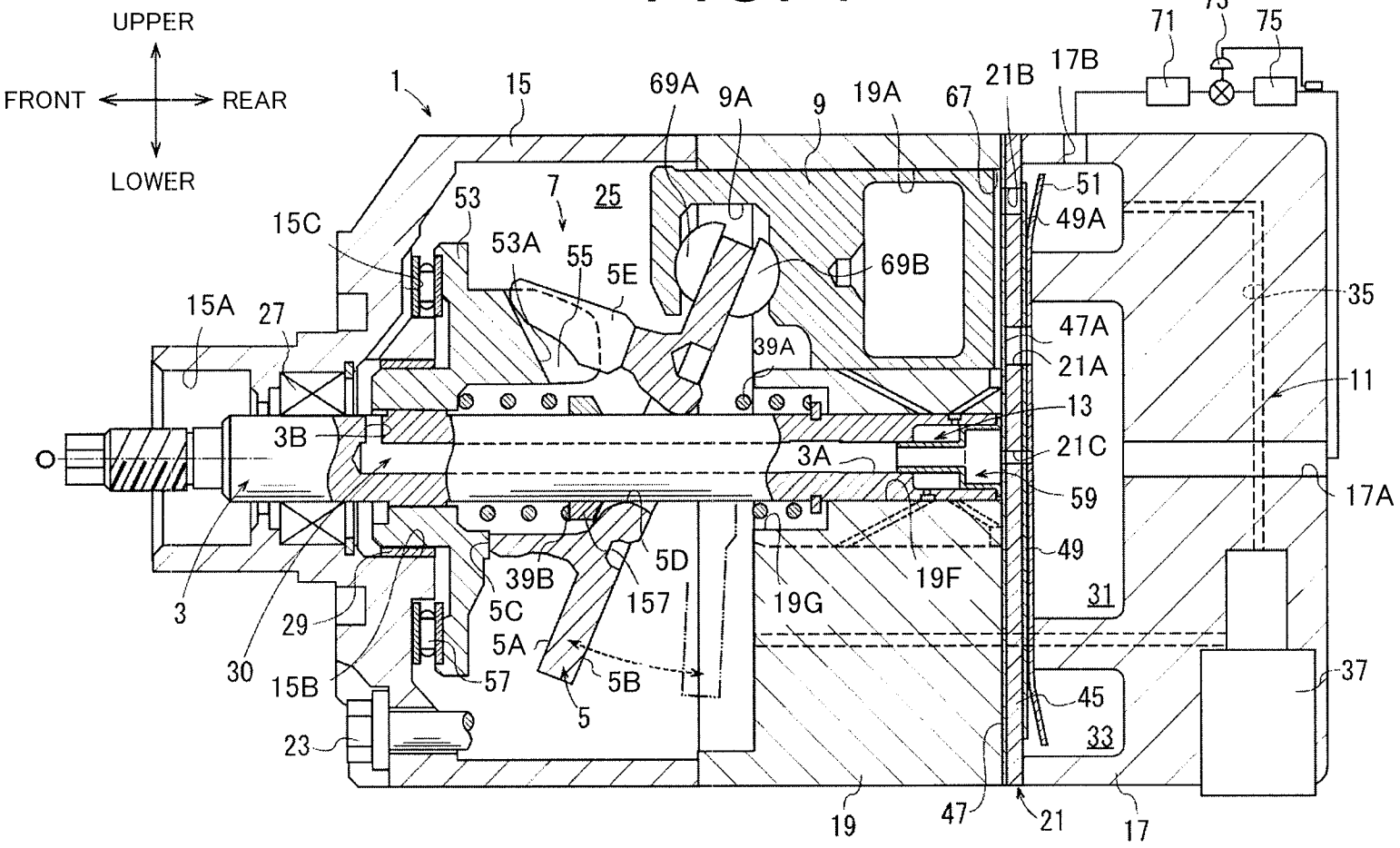
FIG. 1 is a longitudinal sectional view of a compressor according to a first embodiment of the present invention.
Figure 2:
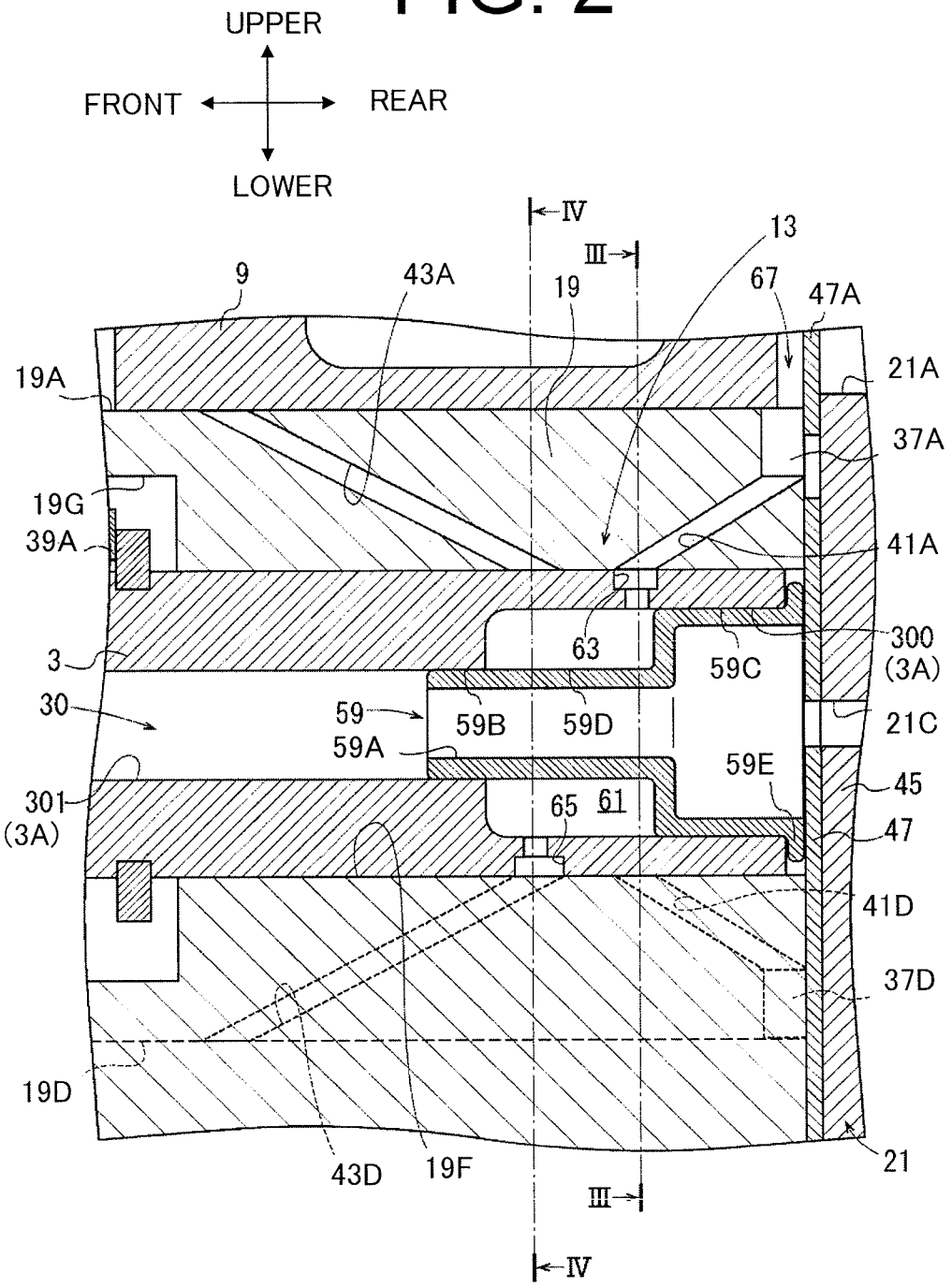
FIG. 2 is an enlarged fragmentary view of the compressor of FIG. 1 showing a collection and supply mechanism of the compressor.

Referencing to FIGS. 1 and 2, the compressor according to the first embodiment of the present invention includes a housing 1, a drive shaft 3, a swash plate 5, an inclination angle change mechanism 7, five pistons 9, a control mechanism 11, and a collection and supply mechanism 13.

As shown in FIG. 1, the housing 1 includes a front housing 15, a rear housing 17, a cylinder block 19 disposed between the front housing 15 and the rear housing 17, and a valve forming plate 21. The front housing 15, the rear housing 17, the cylinder block 19, and the valve forming plate 21 are fastened together by a plurality of through bolts 23.

A crank chamber 25 is formed between the front housing 15 and the cylinder block 19. A boss 15A is formed in the front housing 15 extending frontward. A seal device 27 is provided in the boss 15A. A first shaft hole 15B is formed extending axially in the boss 15A. A slide bearing 29 is provided in the first shaft hole 15B. The front housing 15 has therein a oil passage 15C through which the crank chamber 25 is in communication with the first shaft hole 15B.

The rear housing 17 has therein an inlet 17A, an outlet 17B, a suction chamber 31, and a discharge chamber 33. The suction chamber 31 is formed in the rear housing 17 at a position adjacent to the center of the rear housing 17 and in communication with the inlet 17A. The discharge chamber 33 is formed annularly in the rear housing 17 at a position adjacent to the outer periphery of the rear housing 17 and in communication with the outlet 17B.

The rear housing 17 has therein a supply passage 35 through which the discharge chamber 33 is in communication with the crank chamber 25. A displacement control valve 37 is provided in the supply passage 35. The displacement control valve 37 permits to control the pressure of the crank chamber 25.

Figure 3:
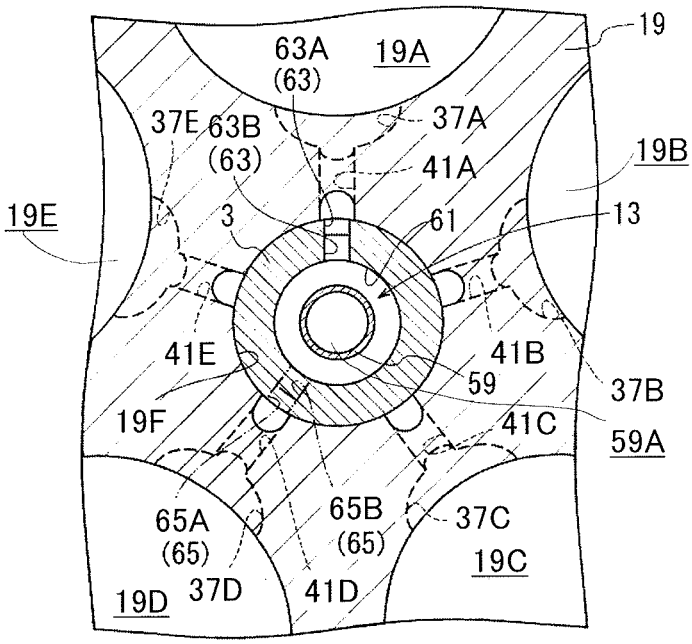
FIG. 3 is a sectional view of the compressor of FIG. 1 as viewed in arrow direction III-III of FIG. 2.
Figure 4:
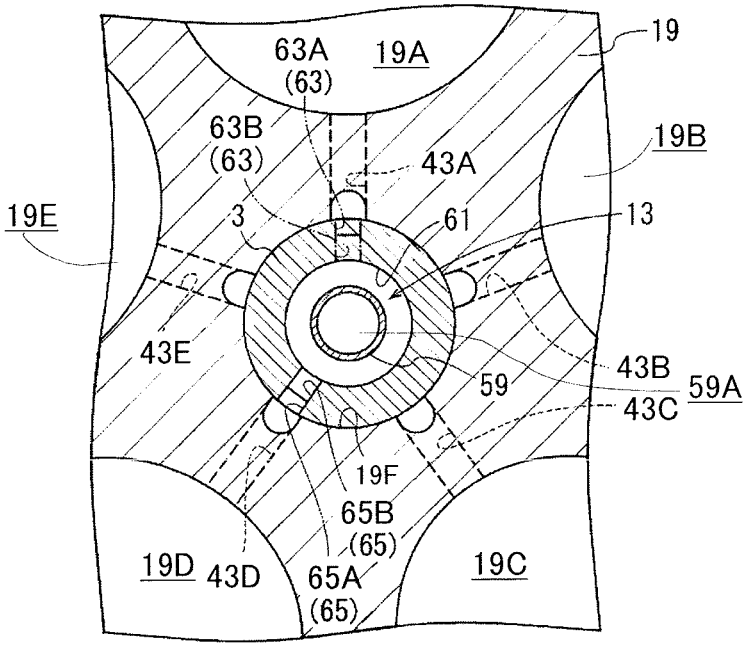
FIG. 4 is a sectional view of the compressor of FIG. 1 as viewed in arrow direction IV-IV of FIG. 2.

As shown in FIGS. 3 and 4, the cylinder block 19 has therein five cylinder bores 19A, 19B, 19C, 19D, 19E. The cylinder bores 19A through 19E are formed at an equal interval in the circumferential direction of the cylinder block 19. As shown in FIG. 3, five retainer grooves 37A, 37B, 37C, 37E, 37E are formed in the cylinder block 19 and in communication with the cylinder bores 19A through 19E, respectively. Each of the retainer grooves 37A through 37E regulates the lift of a suction reed valve 47A described later.

As shown in FIG. 1, the cylinder block 19 has therethrough a second shaft hole 19F that extends axially. A spring chamber 19G is formed in the cylinder block 19. The spring chamber 19G is located between the crank chamber 25 and the second shaft hole 19F. A first return spring 39A is provided in the spring chamber 19G for urging the swash plate 5 in the minimum inclination angle position (shown by two-dot chain line of FIG. 1) toward the front of the crank chamber 25.

The cylinder block 19 has therein collection passages 41A, 41B, 41C, 41D, 41E shown in FIG. 3 and supply passages 43A, 43B, 43C, 43D, 43E shown in FIG. 4. The collection passages 41A through 41E and the supply passages 43A through 43E will be described later.

As shown in FIG. 1, the valve forming plate 21 is located between the cylinder block 19 and the rear housing 17 and closes the rear ends of the cylinder bores 19A through 19E. The valve forming plate 21 includes a valve plate 45, a suction valve plate 47, a discharge valve plate 49, and a retainer plate 51.

A suction port 21A is formed for each of the cylinder bores 19A through 19E through the valve plate 45, the discharge valve plate 49, and the retainer plate 51. A discharge port 21B is formed for each of the cylinder bores 19A through 19E through the valve plate 45 and the suction valve plate 47. Each of the cylinder bores 19A through 19E is communicable with the suction chamber 31 through the suction port 21A and with the discharge chamber 33 through the discharge port 21B, respectively. A communication hole 21C is formed through the valve plate 45, the suction valve plate 47, the discharge valve plate 49, and the retainer plate 51.

The suction valve plate 47 is provided on the front of the valve plate 45. The suction valve plate 47 has suction reed valves 47A that open and close the respective suction ports 21A by elastic deformation. The discharge valve plate 49 is provided on the rear of the valve plate 45. The discharge valve plate 49 has discharge reed valves 49A that open and close the respective discharge ports 21B by elastic deformation. The retainer plate 51 is provided on the rear of the discharge valve plate 49. The retainer plate 51 regulates the lift of the discharge reed valves 49A.

The drive shaft 3 extends through the boss 15A and the rear part of the housing 1. The front part of the drive shaft 3 extends through the seal device 27 in the boss 15A and the rear part of the drive shaft 3 is supported by the inner peripheral surface of the second shaft hole 19F. Thus, the drive shaft 3 is rotatable on its axis of rotation O.

A lug plate 53 and the swash plate 5 are mounted on the drive shaft 3. The lug plate 53 is formed substantially in an annular shape. The lug plate 53 is press-fitted on the drive shaft 3 and supported by the slide bearing 29. Thus, the front part of the drive shaft 3 is supported by the slide bearing 29 and the lug plate 53 is rotatable integrally with the drive shaft 3. A thrust bearing 57 is provided between the lug plate 53 and the front housing 15.

The lug plate 53 has a pair of arms 55 extending rearward from the lug plate 53. The lug plate 53 has an inclination surface 53A between the paired arms 55.

The swash plate 5 is formed in an annular plate shape and has a front surface 5A and a rear surface 5B. The front surface 5A of the swash plate 5 has a stop surface 5C that is brought into contact with the lug plate 53 when the inclination angle of the swash plate 5 becomes maximum. A insertion hole 5D is formed in the center of the swash plate 5. The drive shaft 3 is inserted through the insertion hole 5D.

The swash plate 5 has a pair of swash plate arms 5E extending from the front surface 5A of the swash plate 5 toward the lug plate 53. The inclination angle change mechanism 7 includes the swash plate arms 5E, the arms 55 of the lug plate 53, and the inclination surface 53A of the lug plate 53. The lug plate 53 is connected to the swash plate 5 through the swash plate arms 5E inserted between the arms 55. Thus, the swash plate 5 is rotatable in the crank chamber 25 with the lug plate 53. The end of each swash plate arm 5E is in contact with the inclination surface 53A. The swash plate arms 5E slide in contact with the respective inclination surface 53A. Therefore, the swash plate 5 is movable between the maximum inclination angle position and the minimum inclination angle position as indicated by dotted double-headed arrow of FIG. 1 while allowing the pistons 9 to maintain the top dead center position thereof. For the sake of the description, FIG. 1 shows only one of the arms 55 and of the swash plate arms 5E. According to the present invention, the inclination angle change mechanism 7 may be configured other than that of the first embodiment.

A second return spring 39B and a spring seat 157 are provided between the lug plate 53 and the swash plate 5. The spring seat 157 is brought into contact with the swash plate 5 when the inclination angle of the swash plate 5 becomes maximum. The second return spring 39B urges the swash plate 5 toward the cylinder block 19.

The drive shaft 3 has therethrough an axial passage 3A extending axially from the front end of the drive shaft 3 toward the rear end thereof and a radial passage 3B that extends radially and is in communication with the axial passage 3A at a position adjacent to the front end of the axial passage 3A. As shown in FIG. 2, the axial passage 3A is formed in a stepped configuration having a large diameter portion 300 located at a position adjacent to the rear end of the axial passage 3A and a small diameter portion 301 in the part of the axial passage 3A other than the large diameter portion 300. The rear end of the large diameter portion 300 is closed by a shaft stopper 59. On the other hand, the radial passage 3B is opened to the first shaft hole 15B having an opening at the outer peripheral surface of the drive shaft 3, as shown in FIG. 1.

Figure 5:
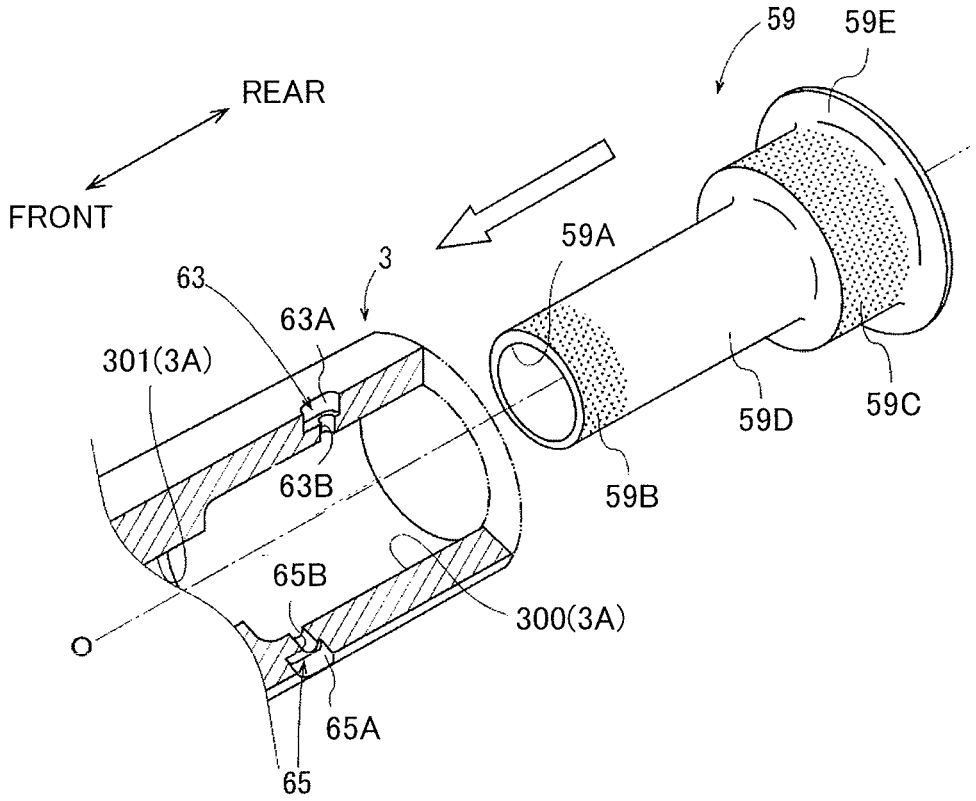
FIG. 5 is a perspective view showing a drive shaft and a shaft stopper of the compressor of FIG. 1.

As shown in FIG. 5, the shaft stopper 59 has a stepped cylindrical shape and has therein a connection passage 59A. The shaft stopper 59 has on the outer periphery thereof a front end fitting portion 59B formed with such a diameter that permits press-fitting of the front end of the shaft stopper 59 into the small diameter portion 301 of the axial passage 3A, a rear end fitting portion 59C formed with such a diameter that permits press-fitting of the rear end of the shaft stopper 59 into the large diameter portion 300 of the axial passage 3A and a intermediate portion 59D formed between the front end fitting portion 59B and the rear end fitting portion 59C. The front end fitting portion 59B and the intermediate portion 59D have substantially the same diameter. A flange portion 59E is formed at the rear end of the shaft stopper 59. The outer diameter of the flange portion 59E is larger than that of the rear end fitting portion 59C and the inner diameter of the large diameter portion 300 of the axial passage 3A. In the shaft stopper 59, the outer diameter of the rear end fitting portion 59C and the flange portion 59E is larger than that of the front end fitting portion 59B and the intermediate portion 59D.

The shaft stopper 59 is press-fitted into the axial passage 3A of the drive shaft 3 by inserting the shaft stopper 59 in arrow direction shown in FIG. 5 from the large diameter portion 300 toward the small diameter portion 301 of the axial passage 3A. In this case, the rear end fitting portion 59C and the front end fitting portion 59B are fitted into the wall surface of the large diameter portion 300 and the wall surface of the small diameter portion 301, respectively, in the areas indicated by dotted hatching. As shown in FIG. 2, the flange portion 59E of the shaft stopper 59 is in contact with the rear end surface of the drive shaft 3. Thus, the flange portion 59E is located between the drive shaft 3 and the valve forming plate 21.

By so press-fitting the shaft stopper 59 in the axial passage 3A, the small diameter portion 301 of the axial passage 3A is in communication with the suction chamber 31 through the connection passage 59A of the shaft stopper 59 and the communication hole 21C of the valve forming plate 21. A bleed passage 30 is formed by the radial passage 3B, the small diameter portion 301, the connection passage 59A, and the communication hole 21C. The crank chamber 25 is communicable with the suction chamber 31 through the bleed passage 30 and the oil passage 15C. The control mechanism 11 includes the bleed passage 30, the supply passage 35, and the displacement control valve 37. The drive shaft 3 has the bleed passage 30 whose rear end is opened to the suction chamber 31.

As shown in FIG. 2, an intermediate portion 59D of the shaft stopper 59 is located in the large diameter portion 300 of the axial passage 3A, so that an annular space 61 is formed around the intermediate portion 59D. The front end fitting portion 59B of the shaft stopper 59 is fitted in the small diameter portion 301 of the axial passage 3A and the rear end fitting portion 59C of the shaft stopper 59 is fitted in the large diameter portion 300 of the axial passage 3A. Thus, the annular space 61 is partitioned, or separated from the small diameter portion 301 and the part of the large diameter portion 300 that is adjacent to the communication hole 21C. The annular space 61 is thus separated from the bleed passage 30 by the shaft stopper 59.

The drive shaft 3 has therethrough and in the rear end thereof an inlet port 63 and an outlet port 65 that are in communication with the annular space 61. The inlet port 63 and the outlet port 65 will be described later.

The pistons 9 are reciprocally slidably received in the cylinder bores 19A through 19E, respectively. In each of the cylinder bores 19A through 19E, a compression chamber 67 is formed between the piston 9 and its corresponding valve forming plate 21.

Figure 6:
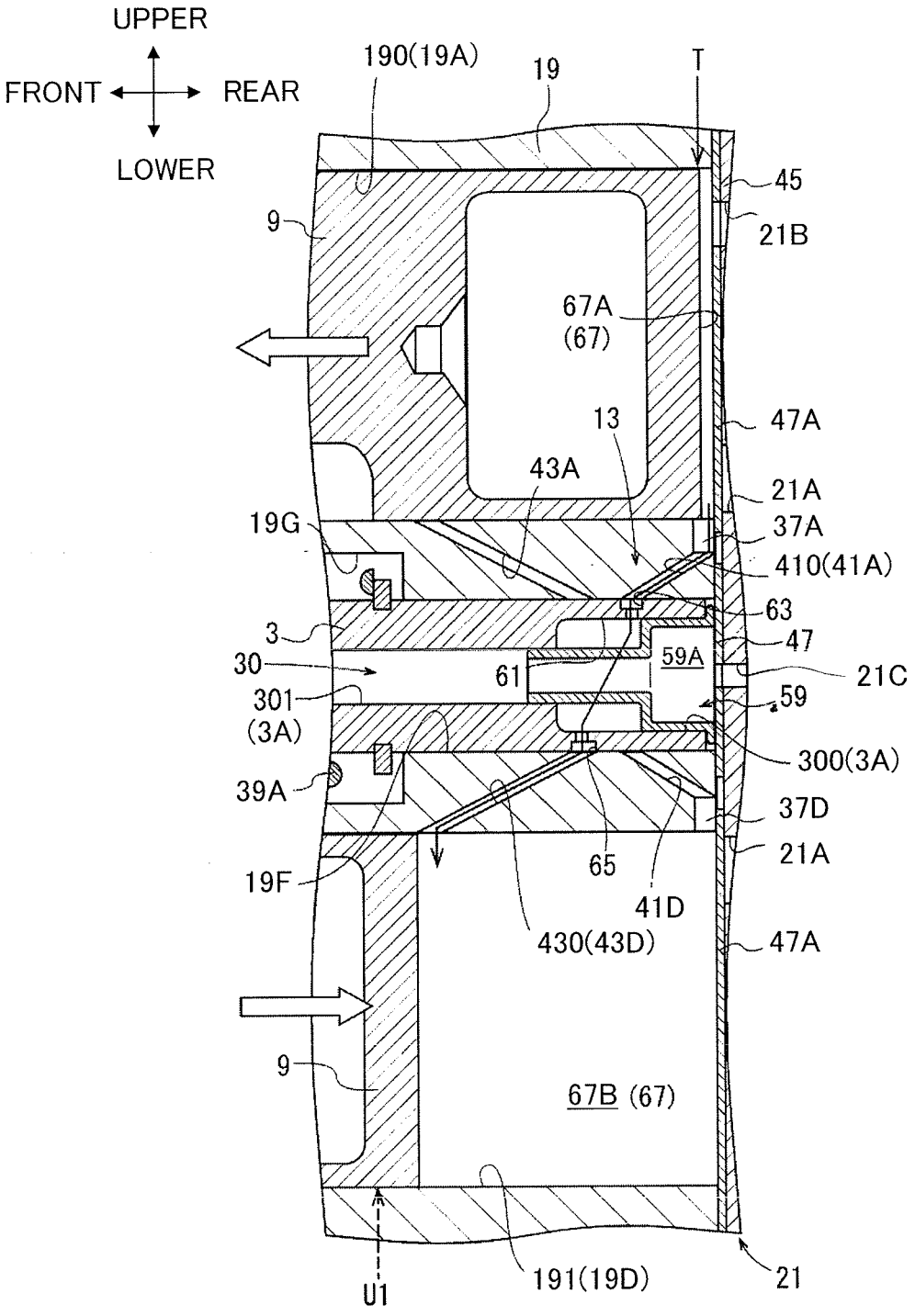
FIG. 6 is an enlarged fragmentary view of the compressor of FIG. 1 showing the pistons in their top dead center position and the bottom dead center position with the swash plate placed in the maximum inclination angle position.

As the piston 9 moves toward the bottom dead center in its cylinder bore, re-expansion phase and suction phase are caused in the compression chambers 67 in the cylinder bore. As the piston 9 moves toward the top dead center in its cylinder bore, compression phase and discharge phase are caused in the compression chambers 67. Referring to FIG. 6, the compression chamber 67 that is in the phase from the end of discharge phase until the end of re-expansion phase serves as a compression chamber 67A of collection phase or the collection-phase compression chamber 67A. The compression chamber 67 that is in the phase of the compression phase serves as a compression chamber 67B of supply phase or the supply-phase compression chamber 67B. Of the cylinder bores 19A through 19E, the cylinder bore forming the collection-phase compression chamber 67A serves a cylinder bore 190 of collection phase or the collection-phase cylinder bore 190 and the cylinder bore forming the supply-phase compression chamber 67B serves as a cylinder bore 191 of supply phase or the supply-phase cylinder bore 191. For example, when the compression chamber 67 formed in the cylinder bore 19A serves as the collection-phase compression chamber 67A, the cylinder bore 19A serves as the collection-phase cylinder bore 190. Similarly, when the compression chamber 67 formed in the cylinder bore 19A serves as the supply-phase compression chamber 67B, the cylinder bore 19A serves as the supply-phase cylinder bore 191.

As shown in FIG. 1, a recess 9A is formed in each piston 9. Hemispherical shoes 69A and 69B are provided in each recess 9A. The rotation of the swash plate 5 is converted to reciprocating motion of the pistons 9 through the shoes 69A and 69B.

The collection and supply mechanism 13 includes collection passages 41A through 41E shown in FIG. 3, the supply passages 43A through 43E shown in FIG. 4, the annular space 61, the inlet port 63, and the outlet port 65 shown in FIG. 2. In the embodiment, the drive shaft 3 has therein a rotation passage formed by the annular space 61 formed around the shaft stopper 59, the inlet port 63 extending from the annular space 61 toward each of the collection passages 41A through 41E, and the outlet port 65 extending form the annular space 61 toward one of the supply passages 43A through 43E. The collection passages 41A through 41E and the supply passages 43A through 43E are communicable with the rotation passage. Thus, the collection-phase cylinder bore 190 and the supply-phase cylinder bore 191 are communicable.

As shown in FIG. 3, the collection passages 41A through 41E extend radially from the second shaft hole 19F toward the cylinder bores 19A through 19E, respectively. Of the collection passages 41A through 41E, the collection passage 41A is in communication with the cylinder bore 19A through the retainer groove 37A. Thus, the cylinder bore 19A is in communication with the second shaft hole 19F through the collection passage 41A. Furthermore, the compression chamber 67 formed in the cylinder bore 19A is in communication with the second shaft hole 19F. Similarly to the collection passage 41A, the collection passages 41B through 41E are in communication with the cylinder bores 19B through 19E through the retainer grooves 37B through 37E, respectively. Thus, the cylinder bores 19B through 19E are in communication with the second shaft holes 19F through the collection passages 41B through 41E, respectively.

As shown in FIG. 6, the collection passages 41A through 41E which are in communication with the cylinder bores 19A through 19E through the retainer grooves 37A through 37E, respectively, are opened to the cylinder bores 19A through 19E, respectively, including a position which is nearer to the valve forming plate 21 than the top dead center position T. Of the collection passages 41A through 41E, the collection passage that is communicable with the annular space 61 through the inlet port 63 serves as a working collection passage 410, which is working actually at the time of collection.

As shown in FIG. 4, the supply passages 43A through 43E extend radially from the second shaft hole 19F toward the cylinder bores 19A through 19E, respectively. The supply passages 43A through 43E extend in the cylinder block 19 in directions opposite to the collection passages 41A through 41E, respectively. Of the supply passages 43A through 43E, the supply passage 43A is in communication with the cylinder bore 19A. Thus, the cylinder bore 19A is in communication with the second shaft hole 19F through the supply passage 43A. Furthermore, the compression chamber 67 is in communication with the second shaft hole 19F through the supply passages 43A. Similarly, the supply passages 43B through 43E come to communicate with the cylinder bores 19B through 19E, respectively, in sequence according to the rotation of the drive shaft 3. Thus, the cylinder bores 19B through 19E come to communicate with the second shaft hole 19F through the supply passages 43B through 43E, respectively, in sequence according to the rotation of the drive shaft 3.

Of the supply passages 43A through 43E, the supply passage that is in communicable the annular space 61 through the outlet port 65, as shown in FIG. 6, serves as a working supply passage 430, which is working actually at the time of supply.

When the swash plate 5 is at the maximum inclination angle position and the piston 9 in the collection-phase cylinder bore 190 is located at the top dead center position, the opening of each of the supply passages 43A through 43E to the inner peripheral surface of its corresponding cylinder bore 19A through 19E is located at a position in which the opening is not closed by the peripheral surface of the pistons 9 in the supply-phase cylinder bore 191.

As shown in FIG. 3, the inlet port 63 extends in radial direction of the drive shaft 3 from the annular space 61 toward one of the collection passages 41A through 41E, respectively. As shown in FIG. 5, the inlet port 63 is opened to the peripheral surface of the drive shaft 3 at a position adjacent to the rear end of the drive shaft 3. The inlet port 63 includes a first recess 63A formed in an elliptical shape on the peripheral surface of the drive shaft 3 and a first communication passage 63B that is provided through the bottom surface of the first recess 63A and extends through the large diameter portion 300 of the drive shaft 3 into the annular space 61. The working collection passage 410 of the collection passages 41A through 41E is in communicable with the annular space 61 through the inlet port 63 with the rotation of the drive shaft 3.

As shown in FIG. 4, the outlet port 65 extends in the radial direction of the drive shaft 3 from the annular space 61 toward one of the supply passages 43A through 43E. As shown in FIG. 5, each outlet port 65 is opened to the peripheral surface of the drive shaft 3 at a position adjacent to the front end of the drive shaft 3 than the inlet port 63. The outlet port 65 includes a second recess 65A formed in an elliptical shape on the peripheral surface of the drive shaft 3 and a second communication passage 65B that is provided through the bottom surface of the second recess 65A and extends into the annular space 61. The working supply passage 430 of the supply passages 43A through 43E is communicable with the annular space 61 through outlet port 65 according to the rotation of the drive shaft 3. Thus, the working collection passage 410 is communicable with the working supply passage 430 through the inlet port 63, the annular space 61, and the outlet port 65. The outlet port 65 is opened at a position that is closer to the front end of the drive shaft 3 than the inlet port 63, so that the working collection passage 410 is prevented from being communicable with the outlet port 65 and the working supply passage 430 is prevented from being communicable with the outlet port 65.

In the compressor according to the first embodiment, the outlet 17B is connected to a condenser 71 through a pipe as shown in FIG. 1. The condenser 71 is connected to an expansion valve 73 through a pipe. The expansion valve 73 is connected to an evaporator 75 through a pipe. The evaporator 75 is connected to the inlet 17A through a pipe. Thus, the compressor composes a part of refrigeration circuit for an air conditioner with the condenser 71, the expansion valve 73, and the evaporator 75.

In the compressor according to the above-described configuration, the rotation of the swash plate 5 driven by the drive shaft 3 causes the pistons 9 to reciprocate in the respective cylinder bores 19A through 19E, thereby to compress the refrigerant gas drawn into the cylinder bores 19A through 19E. In the variable displacement compressor, the capacity of the compression chambers 67 changes according to the stroke length of the pistons 9 that varies with the inclination angle of the swash plate 5. Part of refrigerant gas discharged into the discharge chamber 33 is drawn into the crank chamber 25 through the supply passage 35. The refrigerant gas in the crank chamber 25 is flowed into the suction chamber 31 through the oil passage 15C and the bleed passage 30. Then, the drive shaft 3, the slide bearing 29, and the thrust bearing 57 are lubricated successively by the lubricant oil contained in the refrigerant gas. The crank chamber 25 is communicable with the suction chamber 31 through the bleed passage 30 and with the discharge chamber 33 through the supply passage 35, so that the pressure of the crank chamber 25 can be controlled.

When the pressure in the crank chamber 25 is increased by the displacement control valve 37, the inclination angle of the swash plate 5 is decreased by the inclination angle change mechanism 7. Accordingly, the stroke length of the pistons 9 is decreased. As a result, discharge displacement per rotation of the drive shaft 3 is decreased.

If the pressure in the crank chamber 25 is decreased by the displacement control valve 37, on the other hand, the inclination angle of the swash plate 5 is increased by the inclination angle change mechanism 7. Accordingly, the stroke length of the pistons 9 is increased and then discharge displacement per rotation of the drive shaft 3 is increased.

Figure 7:
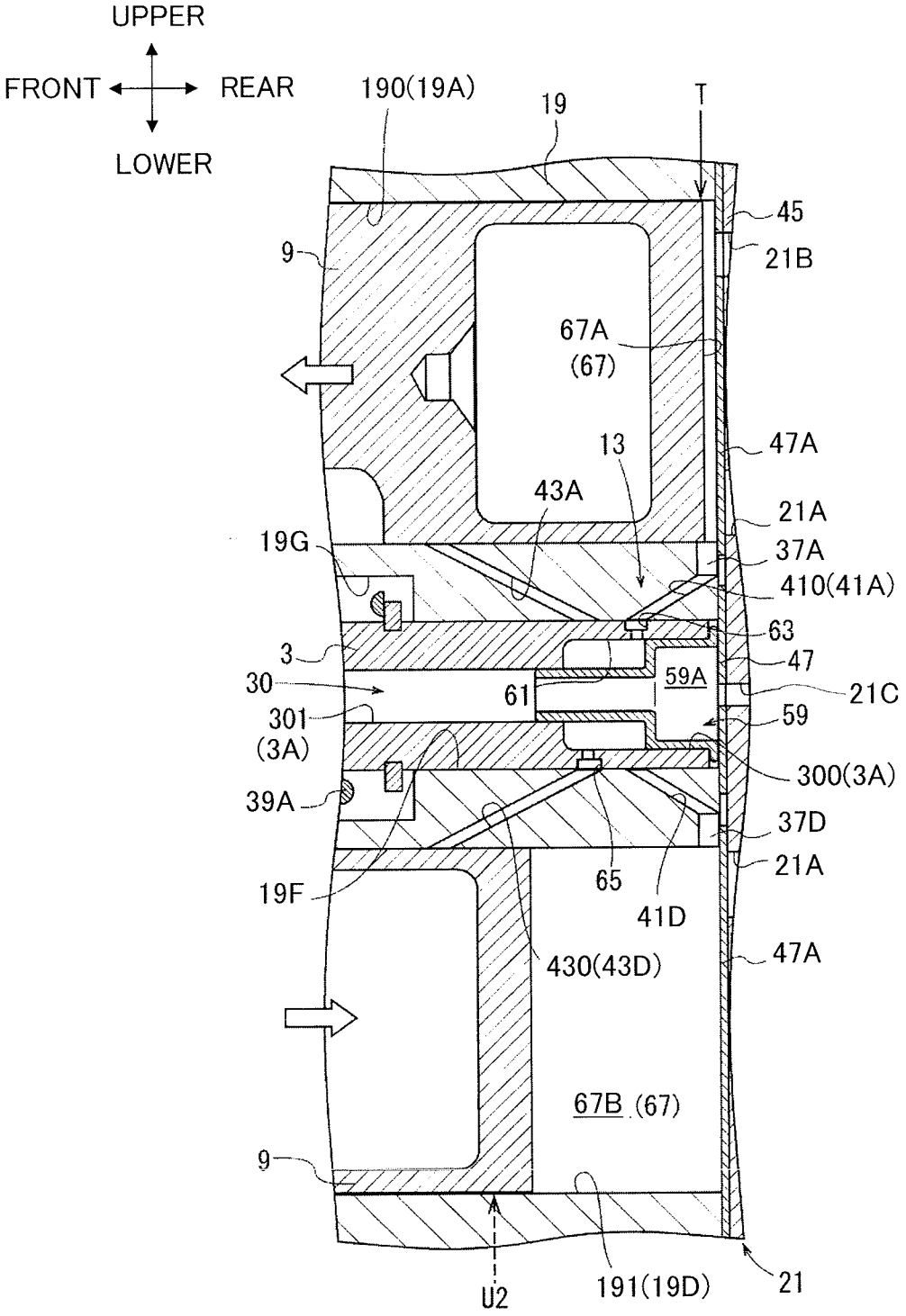
FIG. 7 is an enlarged fragmentary view of the compressor of FIG. 1 showing the pistons in their top dead center position and the bottom dead center position with the swash plate placed at a position that is less than the maximum inclination angle.

In the compressor of the present embodiment, changing the inclination angle of the swash plate 5 is performed by the inclination angle change mechanism 7 in such a way that position of the top dead center position T of each piston 9 shown in FIG. 6 is maintained regardless of the inclination angle of the swash plate 5. In other words, the top dead center position T of each piston 9 is substantially maintained irrespective of the stroke length of the piston 9. When the inclination angle of the swash plate 5 becomes maximum and the stroke length of the piston 9 becomes maximum accordingly, the piston 9 moves between the top dead center position T and the bottom dead center position U1 shown in FIG. 6. When the inclination angle of the swash plate 5 becomes less than the maximum and, therefore, the stroke length of the piston 9 is decreased, the piston 9 moves between the top dead center position T and the bottom dead center position U2 shown in FIG. 7. In the compressor according to the first embodiment, the inclination angle wherein each piston 9 moves between the top dead center position T and the bottom dead center position U2 is set as a setting value.

In the compressor according to the first embodiment, residual refrigerant gas remaining in the collection-phase compression chamber 67A is collected and the collected refrigerant gas is supplied to the supply-phase compression chamber 67B.

Figure 8:
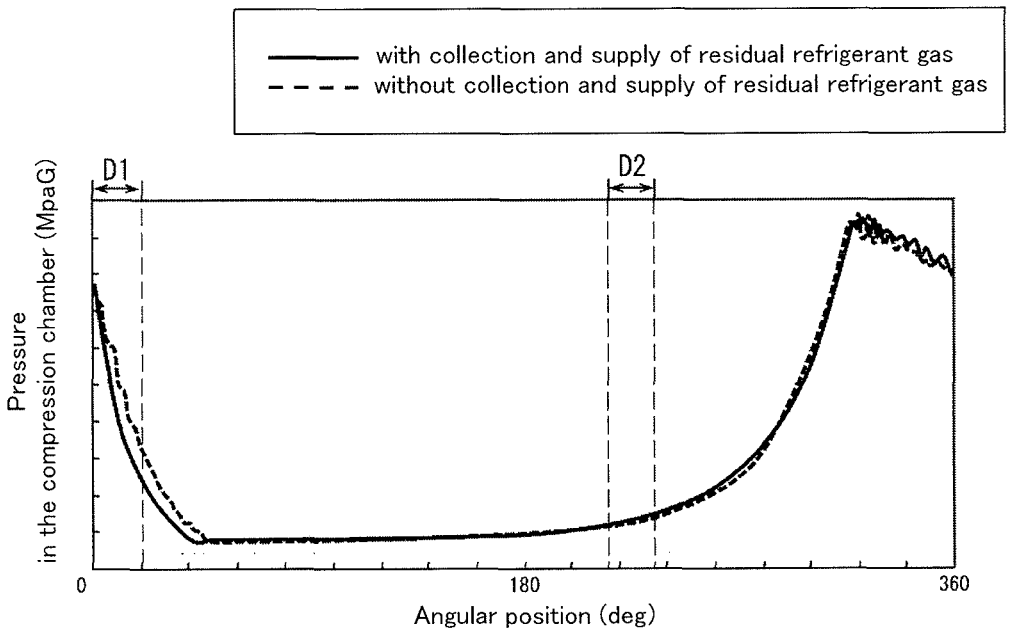
FIG. 8 is a graph showing the relation between the angular position of the drive shaft and the pressure in a compression chamber when the swash plate is at the maximum inclination angle position in the compressor of FIG. 1.
Figure 9:
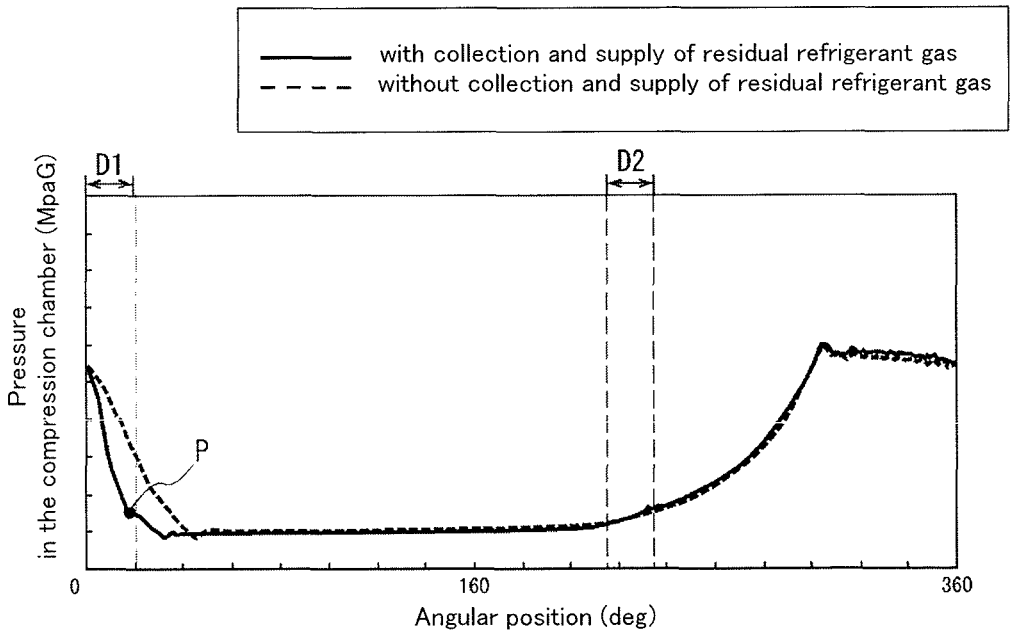
FIG. 9 is a graph showing the relation between the angular position of the drive shaft and the pressure in the compression chamber when the swash plate is at a position that is less than the maximum inclination angle in the compressor of FIG. 1.

To describe specifically while referring to the graphs of FIGS. 8 and 9, the residual refrigerant gas is collected from the compression chamber 67 of the cylinder bore 19A in the range D1 of angular position of the drive shaft 3. The collected residual refrigerant gas is supplied to the compression chamber 67 of the cylinder bore 19A in the range D2 of angular position of the drive shaft 3. That is, when the range of the angular position of the drive shaft 3 is in the range D1, the compression chamber 67 of the cylinder bore 19A serves as the collection-phase compression chamber 67A and the cylinder bore 19A serves as the collection-phase cylinder bore 190. When the angular position of the drive shaft 3 is in the range D2, the compression chamber 67 of the cylinder bore 19A serves as the supply-phase compression chamber 67B and the cylinder bore 19A serves as the supply-phase cylinder bore 191. The ranges of angular positions in which the other cylinder bores 19B through 19E serve as the collection-phase cylinder bore 190 or as the supply-phase cylinder bore 191, respectively, are different from each other.

The following will describe the collection and supply of refrigerant gas that is performed by the collection and supply mechanism 13 using an example in which residual refrigerant gas is collected from the compression chamber 67 of the cylinder bore 19A and the collected refrigerant gas is supplied to the compression chamber 67 of the cylinder bore 19D.

Referring to FIG. 6, the compression chamber 67 of the cylinder bore 19A serves as the collection-phase compression chamber 67A and the compression chamber 67 of the cylinder bore 19D serves as the supply-phase compression chamber 67B. The cylinder bore 19A serves as the collection-phase cylinder bore 190. The cylinder bore 19D serves as the supply-phase cylinder bore 191. The collection passage 41A that is in communication with the cylinder bore 19A is communicable with the annular space 61 through the inlet port 63. Thus, the collection passage 41A serves as the working collection passage 410. The supply passage 43D that is in communication with the cylinder bore 19D is communicable with the annular space 61 through the outlet port 65. Thus, the supply passage 43D serves as the working supply passage 430. Two opposite direction arrows shown in FIG. 6 depict the moving direction of the pistons 9 in the cylinder bores 19A, 19D, respectively. By the collection and supply mechanism 13, the collection-phase cylinder bore 190 and the supply-phase cylinder bore 191 of the cylinder bores 19A through 19E are communicable with a communication passage in the compressor according to the present invention. The communication passage includes the retainer grooves 37A through 37E, the collection passages 41A through 41E, the inlet port 63, the annular space 61, the outlet port 65, and the supply passages 43A through 43E.

When the collection passage 41A has become the working collection passage 410, or when the collection passage 41A is brought into communication with the annular space 61 through the inlet port 63, during the rotation of the drive shaft 3, the residual refrigerant gas in the collection-phase compression chamber 67A is flowed into the annular space 61 through the retainer groove 37A and the working collection passage 410 to be collected, as indicated by solid arrow line in FIG. 6. When the outlet port 65 is brought into communication with the working supply passage 430 according to the rotation of the drive shaft 3, the refrigerant gas collected in the annular space 61 is flowed into the supply-phase compression chamber 67B through the working supply passage 430. Then, the compression phase is caused in the supply-phase compression chamber 67B.

In the compressor according to the first embodiment, when the inclination angle of the swash plate 5 is maximum and the piston 9 in the collection-phase cylinder bore 190 is located at the top dead center position, the opening of each of the supply passages 43A through 43E to the inner peripheral surface of its corresponding cylinder bore 19A through 19E is located at a position in which the opening is not closed by the peripheral surface of the pistons 9 in the supply-phase cylinder bore 191. Specifically, when the inclination angle of the swash plate 5 is maximum, the supply passages 43A through 43E are intermittently communicable with the cylinder bores 19A through 19E, respectively, in accordance with the axial direction position of each piston 9 during reciprocating. Therefore, when the inclination angle of the swash plate 5 is maximum and the piston 9 is moved toward the bottom dead center position U1, the collected refrigerant gas flowed through the working supply passage 430 is allowed to flow into the supply-phase compression chamber 67B. Thus, the residual refrigerant gas in the collection-phase compression chamber 67A can be collected through the working collection passage 410 and the collected refrigerant gas can be supplied to the supply-phase compression chamber 67B through the working supply passage 430. As a result, the refrigerant gas drawn from the suction chamber 31 and the collected refrigerant gas are compressed together in the supply-phase compression chamber 67B.

On the other hand, when the swash plate 5 is at an inclined position that is less than the maximum inclination angle, the stroke length of the piston 9 decreases as compared to the case that the inclination angle is maximum. In this case, the bottom dead center position U2 of the piston 9 is located rearward of the openings of the supply passages 43A through 43E to the cylinder bores 19A through 19E, respectively. Therefore, when the inclination angle of the swash plate 5 is less than the maximum, the supply passages 43A through 43E are closed by the peripheral surface of the pistons 9, even when the pistons 9 are moved to the bottom dead center position U2 in the cylinder bores 19A through 19E, respectively, with the result that the collected refrigerant gas in the working supply passages 430 can not be supplied into the supply-phase compression chamber 67B.

Thus, when the collection and supply mechanism 13 allows the communication passage to be communicable or incommunicable according to the reciprocating motion of each piston 9. The collection and supply mechanism 13 allows the communication passage to be communicable at a maximum value of the inclination angle of the swash plate 5 and allows the communication passage to be incommunicable at a minimum value of the inclination angle of the swash plate 5.

Thus, in the compressor according to the first embodiment, when the inclination angle of the swash plate 5 is less than maximum and the communication area between the working collection passage 410 and the supply-phase compression chamber 67B is zero, the residual refrigerant gas is supplied no more into the supply-phase compression chamber 67B and the residual refrigerant gas in the collection-phase compression chamber 67A is substantially collected no more. Therefore, only the refrigerant gas drawn from the suction chamber 31 is compressed in the supply-phase compression chamber 67B.

In the compressor according to the first embodiment, when the inclination angle of the swash plate 5 is maximum, the residual refrigerant gas in the collection-phase compression chamber 67A is collected and the collected refrigerant gas is supplied into the supply-phase compression chamber 67B. As a result, re-expansion of the residual refrigerant gas in the compression chamber 67 is suppressed from being re-expanded during the re-expansion phase when the swash plate 5 is at its maximum inclination angle position. As shown in the graph of FIG. 8, the pressure of the compression chamber 67 can be decreased more as compared to the case that no collection and supply of the residual refrigerant gas is made. Thus, in the compressor according to the first embodiment, volumetric efficiency of each compression chamber 67 is improved.

In the compressor according to the first embodiment, when the inclination angle of the swash plate 5 becomes less than the maximum value, residual refrigerant gas is supplied no more into the supply-phase compression chamber 67B.

The graph of FIG. 9 shows the relation between the angular position of the drive shaft 3 and the pressure in the compression chamber 67 when the inclination angle of the swash plate 5 is at a position that is less than the maximum value. As shown in solid line curve of the inner pressure wave as a comparative example in which collection and supply of the residual refrigerant gas is made, the inner pressure wave in the cylinder bores 19A through 19E changes rapidly and there is an inflexion point P in the solid line curve. The occurrence of the inflexion point P causes noise in the compressor.

Furthermore, in case that the inclination angle of the swash plate 5 becomes less than the maximum value and collection and supply of residual refrigerant gas is made, the temperature of refrigerant gas in the compression chamber 67 tends to be higher and thus the power required for compression becomes larger and COP is deteriorated.

Compared to the solid line curve, dotted line curve which shows the case that no collection and supply of the residual refrigerant gas is made, the pressure wave in the cylinder bores during the re-expansion, can be changed gradually and moderately as compared to the case that collection and supply of the residual refrigerant gas is made. Therefore, the inflexion point P as shown in solid line curve of the inner pressure wave hardly occurs in the cylinder bore, so that generation of noise can be suppressed. Furthermore, when the compressor is operating with the inclination angle of the swash plate 5 less than the maximum, the temperature of refrigerant gas in the compression chamber 67 can be lowered and the power required for compression can be lessoned because no residual refrigerant gas is supplied into the supply-phase compression chamber 67B.

Therefore, the compressor according to the first embodiment is operated with the noise suppressed and its COP is improved.

According to the first embodiment, the collection and supply mechanism 13 reduces communication area of the communication passage as the inclination angle of the swash plate 5 is reduced from the maximum value, wherein the collection and supply mechanism 13 fully closes the communication passage when the inclination angle of the swash plate 5 becomes a predetermined value.

At a maximum value of the inclination angle of the swash plate 5, residual refrigerant gas is supplied to the supply-phase compression chamber 67B. On the other hand, the collection and supply mechanism 13 reduces communication area of the communication passage as the inclination angle of the swash plate 5 is reduced from the maximum value. Therefore, the flow of the residual refrigerant gas to be collected from the collection-phase compression chamber 67A can be decreased gradually, and the flow of the collected refrigerant gas to be supplied into the supply-phase compression chamber 67B can be decreased gradually. The collection and supply mechanism 13 fully closes the communication passage when the inclination angle of the swash plate 5 becomes a predetermined value, and no collection and supply of the residual refrigerant gas is made in the collection-phase compression chamber 67A and the supply-phase compression chamber 67B, respectively. Therefore, when the inclination angle of the swash plate 5 becomes a predetermined value, generation of noise can be suppressed and COP can be improved. The predetermined value of the inclination angle of the swash plate 5 when the communication passage is fully closed may be the minimum inclination angle of the swash plate 5, or selected according to design, in the range of the inclination angle other than the maximum inclination angle of the swash plate 5. It is noted that the communication passage is closed fully at the minimum value of the inclination angle of the swash plate 5 irrespective of the case that the value except the minimum value of the inclination angle of the swash plate 5 is set as the predetermined value.

The shaft stopper 59 can be fixed in proper position in the drive shaft 3 merely by being press-fitted into the axial passage 3A of the drive shaft 3.

The annular space 61 is formed in the large diameter portion 300 of the axial passage 3A of the drive shaft 3 and separated in the large diameter portion 300 of the axial passage 3A by the shaft stopper 59. Therefore, the annular space 61 can be formed in the drive shaft 3 and the residual refrigerant gas flowing through the annular space 61 is prevented from flowing through the bleed passage 30 into the crank chamber 25 and further into the suction chamber 31. Thus, the bleed passage 30 is separated from the rotation passage including the annular space 61 by the shaft stopper 59.

In the compressor according the first embodiment, the drive shaft 3 is prevented by the shaft stopper 59 from moving axially. This helps to adjust the spaced distance between the drive shaft 3 and the valve forming plate 21 in the manufacturing of the compressor and hence to facilitate the manufacturing.

Second Embodiment

Figure 10A:
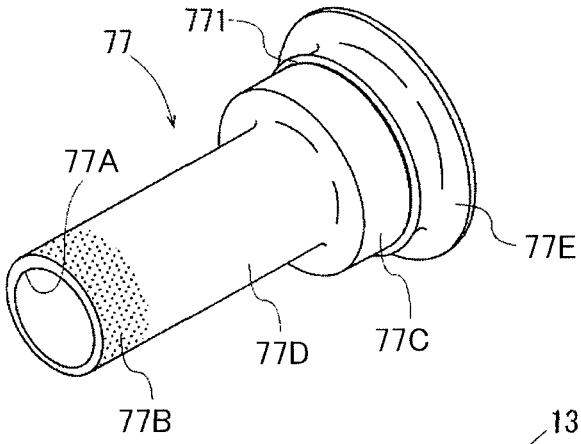
FIG. 10A is a perspective view of a shaft stopper of a compressor according to a second embodiment of the present invention.
Figure 10B:
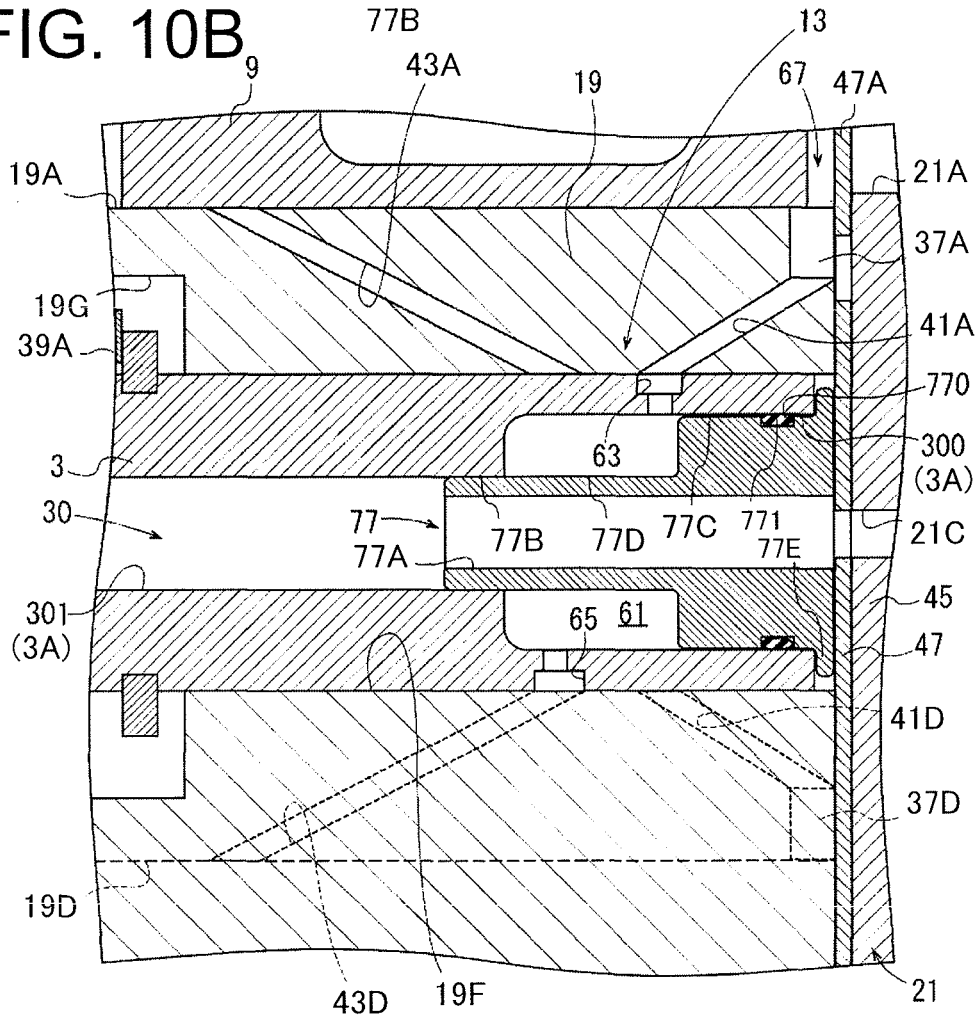
FIG. 10B is an enlarged fragmentary view of the compressor of FIG. 10A having the shaft stopper of FIG. 10A.

The following will describe the compressor of the second embodiment with reference to FIGS. 10A and 10B. The compressor according to the second embodiment differs from the compressor of the first embodiment in that the shaft stopper 59 is replaced by a shaft stopper 77 shown in FIG. 10A. Like the shaft stopper 59, the shaft stopper 77 has a stepped cylindrical shape and has therein a connection passage 77A. The shaft stopper 77 has on the outer periphery thereof a front end fitting portion 77B formed with such a diameter that permits press-fitting of the front end of the shaft stopper 77 into the small diameter portion 301 of the axial passage 3A, a rear large diameter cylindrical portion 77C formed with such a diameter that permits press-fitting of the shaft stopper 77 into the large diameter portion 300 of the axial passage 3A and a intermediate portion 77D formed between the front end fitting portion 77B and the rear large diameter cylindrical portion 77C. The front end fitting portion 77B and the intermediate portion 77D have substantially the same diameter. A flange portion 77E is formed at the rear end of the rear large diameter cylindrical portion 77C. The outer diameter of the flange portion 77E is larger that of the rear large diameter cylindrical portion 77C and the inner diameter of the large diameter portion 300 of the axial passage 3A.

As shown in FIG. 10B, the connection passage 77A is formed in the shaft stopper 77 extending with a constant diameter from the front end fitting portion 77B to the flange portion 77E. The shaft stopper 77 is formed in the outer periphery of the rear large diameter cylindrical portion 77C thereof with a ring groove 770 and an O-ring 771 is provided in the ring groove 770. The O-ring 771 corresponds to the seal member of the present invention. The O-ring 771 is provided between the drive shaft 3 and the shaft stopper 77 to seal the drive shaft 3 and prevent refrigerant gas from leaking.

The shaft stopper 77 is press-fitted into the axial passage 3A of the drive shaft 3 by inserting the shaft stopper 77 from the large diameter portion 300 toward the small diameter portion 301 of the axial passage 3A. In this case, the front end fitting portion 77B is fitted in the small diameter portion 301 of the axial passage 3A in the area that is indicated by dotted hatching in FIG. 10A. The O-ring 771 is elastically deformed by the inner wall surface of the large diameter portion 300. With the shaft stopper 77 thus press-fitted in the drive shaft 3, the small diameter portion 301 of the axial passage 3A is in communication with the suction chamber 31 through the connection passage 77A of the shaft stopper 77 and the communication hole 21C of the valve forming plate 21. In the compressor according to the second embodiment, the bleed passage 30 is formed by the radial passage 3B, the small diameter portion 301, the connection passage 77A and the communication hole 21C.

The intermediate portion 77D of the shaft stopper 77 is located in the large diameter portion 300 of the axial passage 3A, so that the annular space 61 is formed around the intermediate portion 77D. The annular space 61 is separated by the small diameter portion 301 and the rear end of the large diameter portion 300 and separated from the bleed passage 30 by the intermediate portion 77D. In the description of the compressor according to the second embodiment, the same reference numerals are used to denote components or elements that are similar to their counterparts of the first embodiment and the description thereof will be omitted.

In the compressor according to the second embodiment, the annular space 61 is sealed by the O-ring 771, so that the collected refrigerant gas flowing through the annular space 61 can be prevented from flowing through the bleed passage 30 into the crank chamber 25 and the suction chamber 31.

The provision of the O-ring 771 enables the annular space 61 to be sealed successfully without machining the large diameter portion 300 and the rear large diameter cylindrical portion 77C of the shaft stopper 77 to a high accuracy. Therefore, the compressor can be manufactured easily and less costly. The other effects of the compressor according to the second embodiment are the same as those of the compressor according to the first embodiment.

Third Embodiment

Figure 11A:
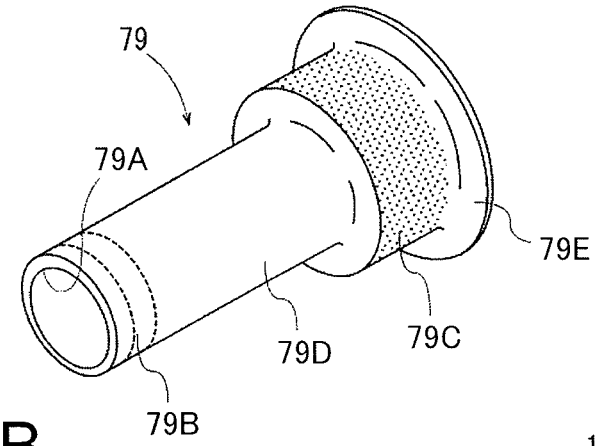
FIG. 11A is a perspective view of a shaft stopper of a compressor according to a third embodiment of the present invention.
Figure 11B:
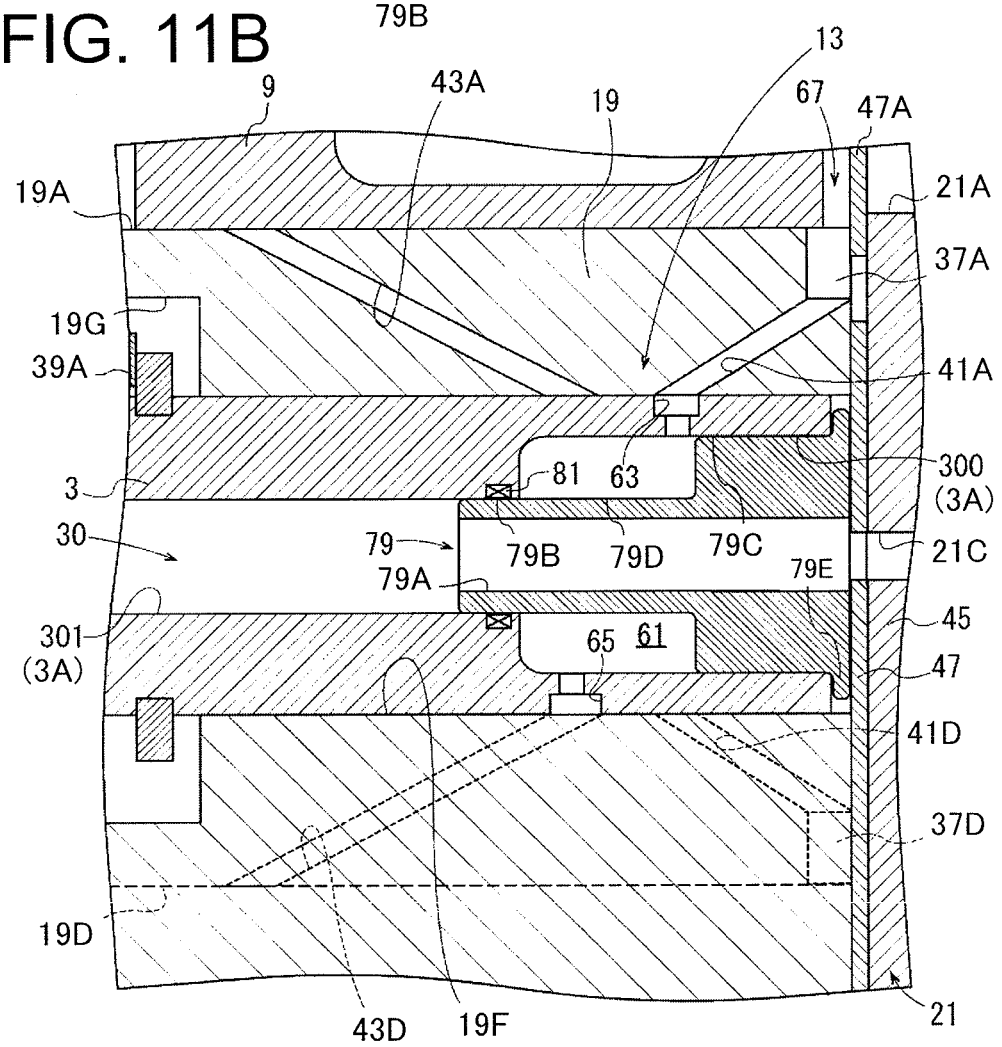
FIG. 11B is an enlarged fragmentary view of the compressor of FIG. 11A having the shaft stopper of FIG. 11A.

The following will describe the compressor of the third embodiment with reference to FIGS. 11A and 11B. The compressor according to the third embodiment differs from the compressor of the first embodiment in that the shaft stopper 59 is replaced by a shaft stopper 79 shown in FIG. 11A. The shaft stopper 79 also has a stepped cylindrical shape and has therein a communication passage 79A. The shaft stopper 79 has on the outer periphery thereof a front end fitting portion 79B formed with such a diameter that permits press-fitting of the front end of the shaft stopper 79 into the small diameter portion 301 of the axial passage 3A, a rear end fitting portion 79C formed with such a diameter that permits press-fitted of the rear end fitting portion 79C into the large diameter portion 300 of the axial passage 3A and a intermediate portion 79D formed between the front end fitting portion 79B and the rear end fitting portion 79C. The front end fitting portion 79B and the intermediate portion 79D have substantially the same diameter. A flange portion 79E is formed at the rear end of the rear end fitting portion 79C. The outer diameter of the flange portion 79E is larger that of the rear end fitting portion 79C and the inner diameter of the large diameter portion 300 of the axial passage 3A. As shown in FIG. 11B, the communication passage 79A is formed in the shaft stopper 79 with a constant diameter from the front end fitting portion 79B to the flange portion 79E.

In the compressor according to the third embodiment, a seal member 81 is provided in an annular groove formed in the inner peripheral surface of the small diameter portion 301 of the axial passage 3A of the drive shaft 3 at a position adjacent to the rear end of the small diameter portion 301. The seal member 81 corresponds to the seal member of the present invention.

The shaft stopper 79 is press-fitted into the axial passage 3A of the drive shaft 3 by inserting the shaft stopper 79 from the large diameter portion 300 toward the small diameter portion 301 of the axial passage 3A. In this case, the front end fitting portion 79B closely contacts with the seal member 81 in the area on the shaft stopper 79 between two dotted lines of FIG. 11A. On the other hand, the rear end fitting portion 79C is fitted into the rear part of the large diameter portion 300 of the axial passage 3A in the area indicated by dotted hatching in the FIG. 11A. With the shaft stopper 79 thus press-fitted into the axial passage 3A of the drive shaft 3, the small diameter portion 301 of the axial passage 3A is in communication with the suction chamber 31 through the communication passage 79A of the shaft stopper 79 and the communication hole 21C of the valve forming plate 21. The bleed passage 30 is formed by the radial passage 3B, the small diameter portion 301, the communication passage 79A and the communication hole 21C.

The intermediate portion 79D of the shaft stopper 79 is located in the large diameter portion 300 of the axial passage 3A, so that the annular space 61 is formed around the intermediate portion 79D. The annular space 61 is separated by the small diameter portion 301 and the rear end of the large diameter portion 300 and separated from the bleed passage 30 by the intermediate portion 79D. In the description of the compressor according to the third embodiment, the same reference numerals are used to denote components or elements that are similar to their counterparts of the first embodiment In the compressor according to the third embodiment, the annular space 61 is sealed by the seal member 81 provided on the drive shaft 3 and around the front end fitting portion 79B of the shaft stopper 79, as in the case of the compressor according to the second embodiment. The provision of the seal member 81 enables the annular space 61 to be sealed successfully without machining the small diameter portion 301 and the front end fitting portion 79B of the shaft stopper 79 to a high accuracy. Therefore, the compressor can be manufactured easily and less costly. The other effects of the compressor according to the third embodiment are the same as those of the compressor according to the first embodiment.

Fourth Embodiment

Figure 12A:
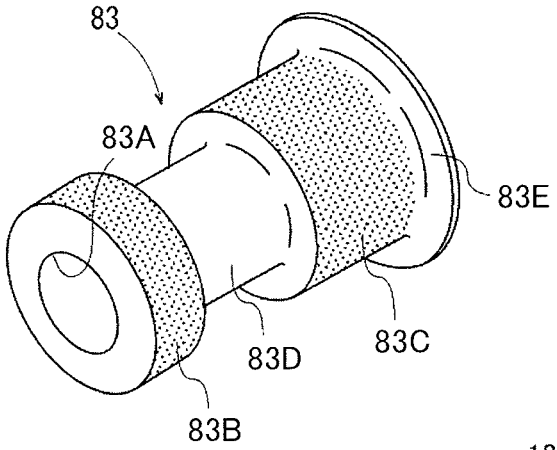
FIG. 12A is a perspective view of a shaft stopper of a compressor according to a fourth embodiment of the present invention.
Figure 12B:
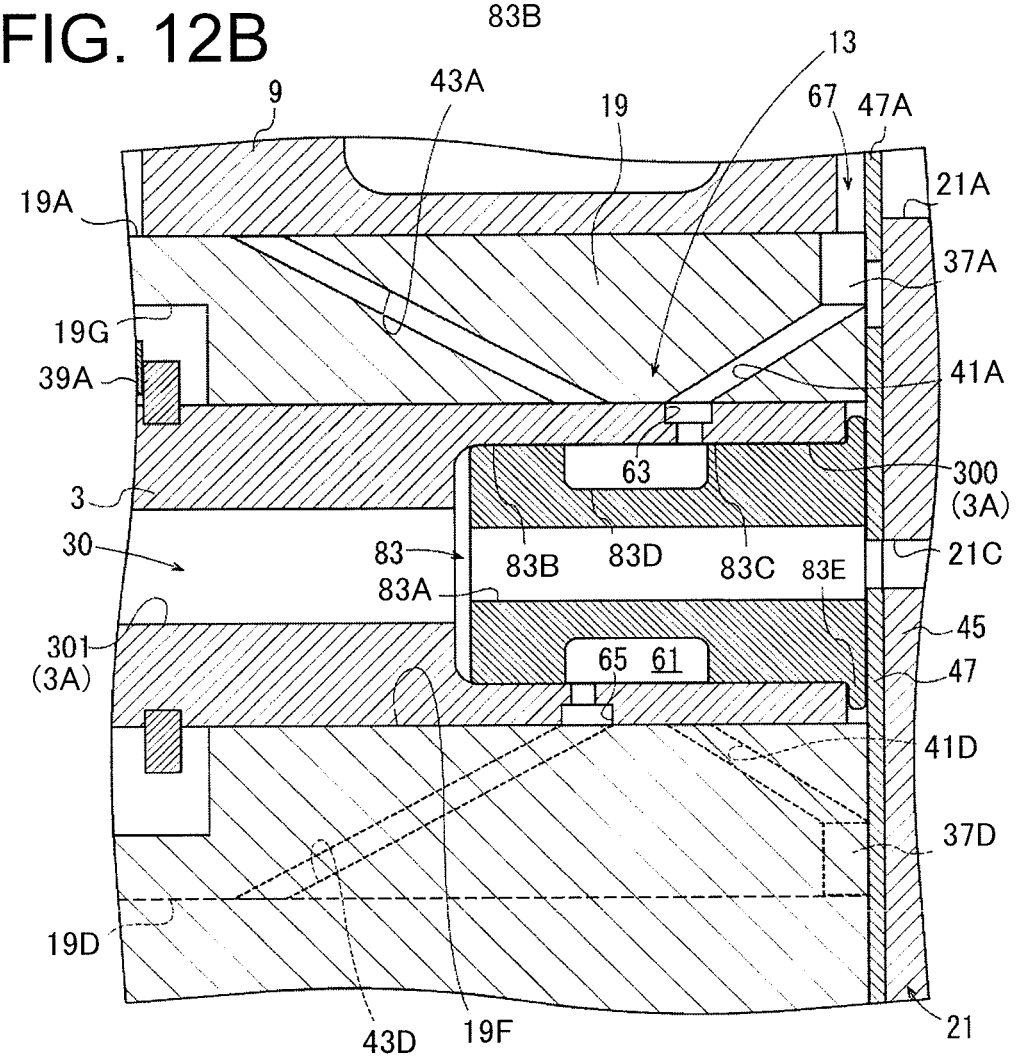
FIG. 12B is an enlarged fragmentary view of the compressor of FIG. 12A having the shaft stopper of FIG. 12A.

The following will describe the compressor of the fourth embodiment with reference to FIGS. 12A and 12B. The compressor according to the fourth embodiment differs from the compressor of the first embodiment in that the shaft stopper 59 is replaced by a shaft stopper 83 shown in FIG. 12A. As is apparent from comparison of FIG. 2 and FIG.

12B, the large diameter portion 300 of the axial passage 3A is formed longer axially than that of the compressor according to the first embodiment.

As shown in FIG. 12A, the shaft stopper 83 has a stepped cylindrical shape and has therein a connection passage 83A. The shaft stopper 83 has a front end fitting portion 83B and a rear end fitting portion 83C which are formed with such a diameter that permits press-fitting of the front end fitting portion 83B and the rear end fitting portion 83C into the large diameter portion 300. The shaft stopper 83 further has a recessed intermediate portion 83D located between the front end fitting portion 83B and the rear end fitting portion 83C. The outer diameter of the intermediate portion 83D is smaller than that of the front end fitting portion 83B and the rear end fitting portion 83C. A flange portion 83E is formed at the rear end of the rear end fitting portion 83C. The outer diameter of the flange portion 83E is larger than that of the front end fitting portion 83B, the rear end fitting portion 83C, and the inner diameter of the large diameter portion 300. The connection passage 83A in the shaft stopper 83 is formed with a constant diameter.

The shaft stopper 83 is press-fitted in the large diameter portion 300 of the axial passage 3A of the drive shaft 3. Specifically, the front end fitting portion 83B is fitted in the front part of the large diameter portion 300 and the rear end fitting portion 83C is fitted in the rear part of the large diameter portion 300. Thus the shaft stopper 83 is press-fitted in the large diameter portion 300 of the axial passage 3A of the drive shaft 3, so that the small diameter portion 301 of the axial passage 3A is in communication with the suction chamber 31 through the connection passage 83A and the communication hole 21C. In the compressor according to the fourth embodiment, the bleed passage 30 is formed by the radial passage 3B, the small diameter portion 301 of the axial passage 3A, the connection passage 83A, and the communication hole 21C.

The intermediate portion 83D is formed approximately in the center of the large diameter portion 300 as seen in the axial direction of the drive shaft 3 and the annular space 61 is formed around the intermediate portion 83D. The annular space 61 is separated by the front end of the large diameter portion 300 and the rear end of the large diameter portion 300 and separated from the bleed passage 30 by the intermediate portion 83D. In the description of the compressor according to the fourth embodiment, the same reference numerals are used to denote components or elements that are similar to their counterparts of the first embodiment.

In the compressor according to the fourth embodiment wherein the front end fitting portion 83B and the rear end fitting portion 83C have the same outer diameter, the shaft stopper 83 can be made easily, so that the compressor can be manufactured easily and less costly. The other effects of the compressor according to the fourth embodiment are the same as those of the compressor according to the first embodiment.

Fifth Embodiment

Figure 13A:
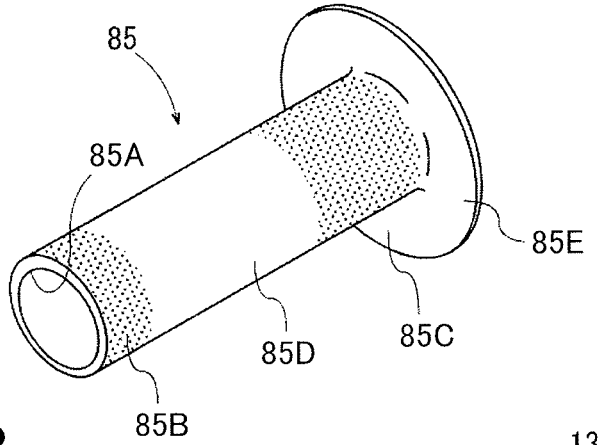
FIG. 13A is a perspective view of a shaft stopper of a compressor according to a fifth embodiment of the present invention.
Figure 13B:
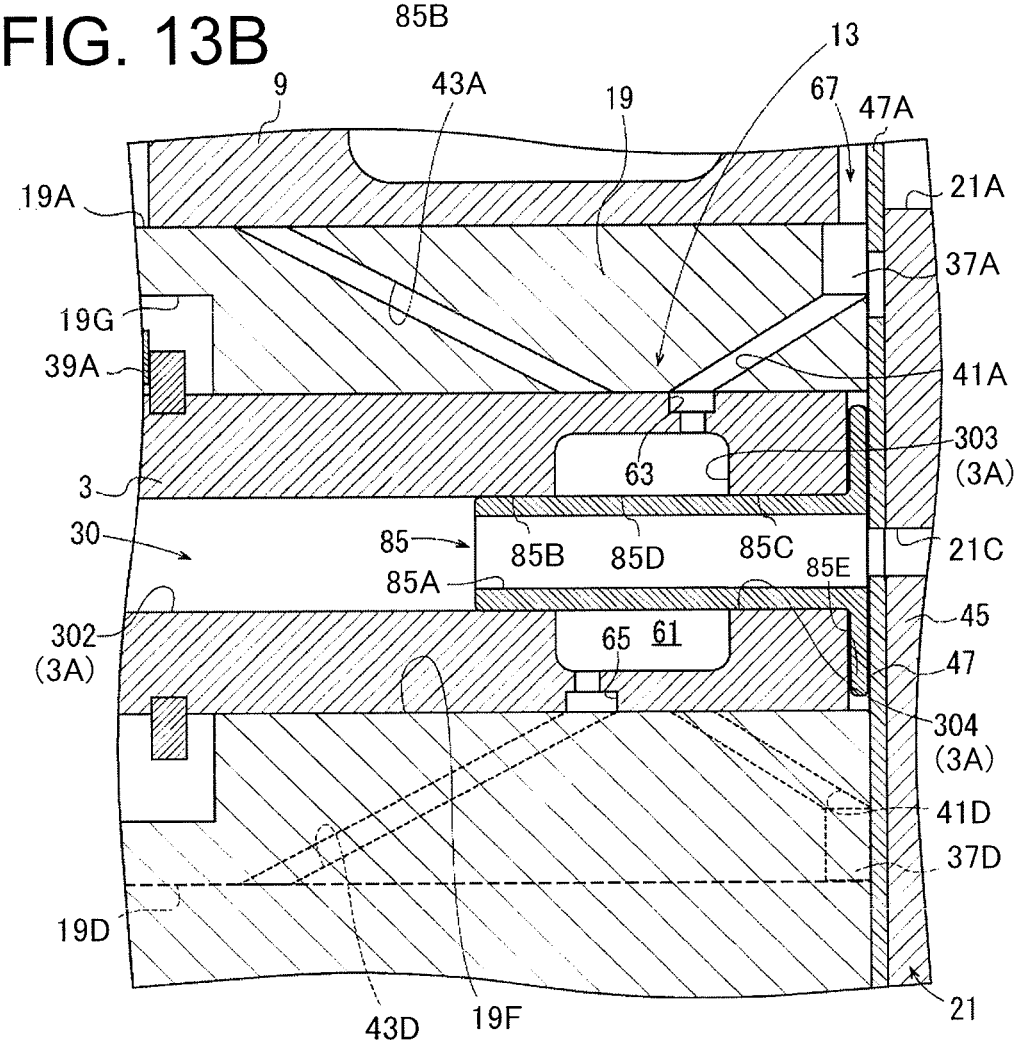
FIG. 13B is an enlarged fragmentary view of the compressor of FIG. 12A having the shaft stopper of FIG. 13A.

The following will describe the compressor of the fifth embodiment with reference to FIGS. 13A and 13B. The compressor according to the fifth embodiment differs from the compressor of the first embodiment in that the shaft stopper 59 is replaced by a shaft stopper 85 shown in FIG. 13A. As shown in FIG. 13B, the axial passage 3A has a first small diameter portion 302, a large diameter portion 303 and a second small diameter portion 304. The first small diameter portion 302 and the second small diameter portion 304 have substantially the same outer diameter. The first small diameter portion 302 is in communication with the radial passage 3B shown in FIG. 1 at the front end thereof. The large diameter portion 303 shown in FIG. 13B is in communication with the first small diameter portion 302 at the front end thereof and in communication with the second small diameter portion 304 at the rear end thereof. The large diameter portion 303 is formed axially shorter than the large diameter portion 300 of the compressor according to the first embodiment. The rear end of the second small diameter portion 304 is opened at the rear end surface of the drive shaft 3.

As shown in FIG. 13A, the shaft stopper 85 has a cylindrical shape and has therethrough a connection passage 85A. The shaft stopper 85 has on the outer periphery thereof a front end fitting portion 85B and a rear end fitting portion 85C which are formed with such a diameter that permits press-fitting of the front end fitting portion 85B and the rear end fitting portion 85C into the first small diameter portion 302 and the second small diameter portion 304, respectively. An intermediate portion 85D is formed between the front end fitting portion 85B and the rear end fitting portion 85C. The front end fitting portion 85B, the rear end fitting portion 85C, and the intermediate portion 85D have substantially the same outer diameter. A flange portion 85E is formed at the rear end of the rear end fitting portion 85C. The diameter of the flange portion 85E is larger than that of the rear end fitting portion 85C and the second small diameter portion 304. As shown in FIG. 13B, the connection passage 85A in the shaft stopper 85 extends with a constant diameter from the front end fitting portion 85B to the flange portion 85E.

The shaft stopper 85 is press-fitted by inserting the shaft stopper 85 into the drive shaft 3 from the second small diameter portion 304 toward the first small diameter portion 302. In this case, the shaft stopper 85 is inserted with the front end fitting portion 85B and the rear end fitting portion 85C fitted in the first small diameter portion 302 and the second small diameter portion 304, respectively, in the areas indicated by dotted hatching in FIG. 13A. With the shaft stopper 85 thus press-fitted in the axial passage 3A of the drive shaft 3, the first small diameter portion 302 is in communication with the suction chamber 31 through the connection passage 85A and the communication hole 21C. The bleed passage 30 is formed by the radial passage 3B, the first small diameter portion 302, the connection passage 85A, and the communication hole 21C.

The intermediate portion 85D is located in the large diameter portion 303, so that the annular space 61 is formed around the intermediate portion 85D. The annular space 61 is separated by the first small diameter portion 302 and the second small diameter portion 304 and separated from the bleed passage 30 by the intermediate portion 85D. The rest of the configuration of the compressor according to the fifth embodiment is substantially the same as that of the compressor according to the first embodiment.

In the compressor according to the fifth embodiment, the front end fitting portion 85B, the rear end fitting portion 85C, and the intermediate portion 85D have the same outer diameter, so that the shaft stopper 85 can be made easily and less costly. Therefore, the compressor can be manufactured easily and low cost of the compressor can be achieved. The other effects of the compressor according to the fifth embodiment are the same as those of the compressor according to the first embodiment.

Though the present invention has been described with reference to the first through fifth embodiments, the present invention is not limited to such embodiments and it may be modified into alternative embodiments as exemplified below.

For example, the position at which the supply passages 43A through 43E are opened to the cylinder bores 19A through 19E may be set so that each of the supply passages 43A through 43E is closed gradually by the piston 9 with a decrease of the inclination angle of the swash plate 5 and hence with a decrease of the stroke length of the piston 9. In this case, when the inclination angle of the swash plate 5 is less than maximum, the area of communication between the working collection passage 410 and the working supply passage 430 is decreased gradually. Therefore, the flow of the collected refrigerant gas to be supplied into the supply-phase compression chamber 67B is decreased gradually with a decrease of the inclination angle of the swash plate 5.

Furthermore, the communication passage may have a structure to have exclusive collection passages in communication with the respective cylinder bores 19A through 19E for residual refrigerant gas collected from the collection-phase compression chamber 67A and exclusive supply passages communicable with the respective cylinder bores 19A through 19E for the residual refrigerant gas supplied to the supply-phase compression chamber 67B. The communication passage may have a structure wherein the communication passage is communicable with the cylinder bores 19A through 19E and residual refrigerant gas collected from the collection-phase compression chamber 67A and the residual refrigerant gas supplied to the supply-phase compression chamber 67B are flowed alternatively through the communication passage.

The inclination angle change mechanism 7 may include a various type of link mechanism or a various type of wobbling motion conversion mechanism that can change the inclination angle of the swash plate 5. The control mechanism 11 may include a displacement control valve or an actuator that can control the inclination angle change mechanism 7.

The present invention is applicable to an air conditioner.

What is claimed is:

1. A swash plate type variable displacement compressor comprising:

a drive shaft having an axis;

a housing supporting the drive shaft so that the drive shaft is rotatable about the axis, the housing having therein a crank chamber and a plurality of cylinder bores, which include first and second cooperating cylinder bores, arranged around the axis of the drive shaft;

a swash plate which is rotatable with rotation of the drive shaft in the crank chamber;

an inclination angle change mechanism which changes an inclination angle of the swash plate with respect to a plane extending perpendicularly to the axis of the drive shaft;

a plurality of pistons, including first and second cooperating pistons, each reciprocally movably received in a corresponding one of the plurality of cylinder bores in accordance with the rotation of the swash plate, wherein a plurality of compression chambers, including first and second cooperating compression chambers, are formed within the plurality of cylinder bores, wherein, when the plurality of pistons are moved within the plurality of cylinder bores, one of: a re-expansion phase, suction phase, compression phase and discharge phase occurs within each of the plurality of compression chambers, the first cooperating piston and the first cooperating compression chamber being provided within the first cooperating cylinder bore, and the second cooperating piston and the second cooperating compression chamber being provided within the second cooperating cylinder bore;

a control mechanism controlling the inclination angle change mechanism; and a collection and supply mechanism which collects refrigerant gas in the first cooperating compression chamber and supplies the collected refrigerant gas to the second cooperating compression chamber when the first cooperating compression chamber is in a phase from an end of the discharge phase until an end of the re-expansion phase and the second cooperating compression chamber is in the compression phase, the collection and supply mechanism having a communication passage comprising:

a rotation passage that is formed in the drive shaft;

a cooperating collection passage among a plurality of collection passages that are formed in the housing and configured to communicate with the rotation passage; and a cooperating supply passage among a plurality of supply passages that are formed in the housing and configured to communicate with the rotation passage, wherein a first end of the cooperating collection passage is in communication with the first cooperating compression chamber irrespective of a reciprocating motion of the first cooperating piston, wherein a second end of the cooperating collection passage is selectively communicated with the rotation passage by opening and closing the second end of the cooperating collection passage based upon a rotation of the drive shaft, wherein a first end of the cooperating supply passage is in selective communication with the second cooperating compression chamber by opening and closing the first end of the cooperating supply passage based upon an axial position of a peripheral surface of the second cooperating piston, which selectively opens and closes the first end of the cooperating supply passage during reciprocating motion, and wherein a second end of the cooperating supply passage selectively communicates with the rotation passage by opening and closing the second end of the cooperating supply passage based upon the rotation of the drive shaft, and the cooperating supply passage communicating with the second cooperating compression chamber at a maximum value of an inclination angle of the swash plate and not communicating with the second cooperating compression chamber at the minimum value of the inclination angle of the swash plate, wherein the rotation passage is configured to communicate with both the cooperating supply passage and the cooperating collection passage when the cooperating supply passage is in communication with the second cooperating compression chamber, thereby allowing a residual refrigerant gas accumulated in the first cooperating compression chamber and the collected refrigerant gas to be supplied into the second cooperating compression chamber via the cooperating supply passage.

2. The swash plate type variable displacement compressor according to claim 1, wherein the collection and supply mechanism reduces communication area of the communication passage as the inclination angle is reduced from the maximum value, wherein the collection and supply mechanism fully closes the communication passage when the inclination angle becomes a predetermined value.

3. The swash plate type variable displacement compressor according to claim 1, wherein the housing has therein a suction chamber, wherein the drive shaft has a bleed passage whose rear end is opened to the suction chamber, the bleed passage providing communication between the crank chamber and the suction chamber, and wherein the drive shaft is provided with a cylindrical member whose inner peripheral surface provides the bleed passage and whose outer peripheral surface provides the rotation passage in the drive shaft.

4. The swash plate type variable displacement compressor according to claim 3, wherein a seal member which seals the bleed passage and the rotation passage is provided between the drive shaft and the cylindrical member.

5. The swash plate type variable displacement compressor according to claim 3, wherein the rotation passage includes an annular space formed annularly around the cylindrical member, an inlet port extending from the annular space toward one of the collection passages and an outlet port extending from the annular space toward one of the supply passages.

6. The swash plate type variable displacement compressor according to claim 3, wherein the cylindrical member has therein a front end fitting portion, a rear end fitting portion, and a intermediate portion that is located between the front end fitting portion and the rear end fitting portion and faces the annular space, wherein at least one of the front end fitting portion and the rear end fitting portion is fixed in the drive shaft by press-fitting.

7. The swash plate type variable displacement compressor according to claim 3, wherein the cylindrical member serves as a shaft stopper that prevents the drive shaft from moving axially.

* * * * *